US005675702A

United States Patent [19]

Gerson et al.

[11] Patent Number: 5,675,702

[45] Date of Patent: Oct. 7, 1997

[54] MULTI-SEGMENT VECTOR QUANTIZER FOR A SPEECH CODER SUITABLE FOR USE IN A RADIOTELEPHONE

[75] Inventors: Ira A. Gerson, Schaumburg; Mark A. Jasiuk, Chicago; Matthew A. Hartman, Schaumburg, all of Ill.

[73] Assignee: Motorola, Inc., Schaumburg, Ill.

[21] Appl. No.: 611,608

[22] Filed: Mar. 8, 1996

Related U.S. Application Data

[63] Continuation of Ser. No. 37,793, Mar. 26, 1993, abandoned.

[51] Int. Cl.[6] ..... G10L 9/08

[52] U.S. Cl. ..... 395/2.32; 395/2.26

[58] Field of Search ..... 395/2.25–2.32, 395/2.38, 2.39, 2.92, 2.95

[56] References Cited

U.S. PATENT DOCUMENTS 4,544,919 10/1985 Gerson ..... 381/41
4,896,361 1/1990 Gerson ..... 381/40

OTHER PUBLICATIONS

R. Viswanathan and J. Makhour, "Quantization Properties of Transmission Parameters In Linear Predictive Systems", IEEE Trans. Acoust., Speech, Signal Processing, vol. ASSP-23, pp. 309–321, Jun. 1975.

Y. Linde, A. Buzo and R. M. Gray, "An Algorithm For Vector Quantizer Design", IEEE Trans. on Comm., vol. Com-28, No. 1, pp. 84–95, Jan. 1980.

Motorola, Inc., "Vector Sum Excited Linear Prediction (VSELP) 7950 Bit Per Second Voice Coding Algorithm–Technical Description," Nov. 14, 1989, pp. 9–11.

Y. Shoham, "Cascaded Likelihood Vector Coding of the LPC Information," Proc. of Int. Conf. on Acoustics, Speech and Signal Proc., pp. 160–163, 1989.

K.K. Paliwal and B. S. Atal, "Efficient Vector Quantization of LPC Parameters at 24 Bits/Frame," Proc. of Int. Conf. on Acoustics, Speech and Signal Proc., pp. 661–664,1991.

B. Bhattacharya, et al., "Tree searched Multi–Stage Vector Quantization of LPC Parameters for 4 kb/s Speech Coding," Proc. of Int. Conf. on Acoustics Speech and Signal Proc., pp. I–105 to I–108, Mar. 1992.

*Primary Examiner*—David D. Knepper
*Attorney, Agent, or Firm*—John G. Rauch

[57] ABSTRACT

A Vector-Sum Excited Linear Predictive Coding (VSELP) speech coder provides improved quality and reduced complexity over a typical speech coder. VSELP uses a codebook which has a predefined structure such that the computations required for the codebook search process can be significantly reduced. This VSELP speech coder uses single or multi-segment vector quantizer of the reflection coefficients based on a Fixed-Point-Lattice-Technique (FLAT). Additionally, this speech coder uses a pre-quantizer to reduce the vector codebook search complexity and a high-resolution scalar quantizer to reduce the amount of memory needed to store the reflection coefficient vector codebooks. Resulting in a high quality speech coder with reduced computations and storage requirements.

14 Claims, 3 Drawing Sheets

MULTI-SEGMENT VECTOR QUANTIZER FOR A SPEECH CODER SUITABLE FOR USE IN A RADIOTELEPHONE

This is a continuation of application Ser. No. 08/037,793, filed Mar. 26, 1993, and now abandoned.

FIELD OF THE INVENTION

The present invention generally relates to speech coders using Code Excited Linear Predictive Coding (CELP), Stochastic Coding or Vector Excited Speech Coding and more specifically to vector quantizers for Vector-Shin Excited Linear Predictive Coding (VSELP).

BACKGROUND OF THE INVENTION

Code-excited linear prediction (CELP) is a speech coding technique used to produce high quality synthesized speech. This class of speech coding, also known as vector-excited linear prediction, is used in numerous speech communication and speech synthesis applications. CELP is particularly applicable to digital speech encrypting and digital radiotelephone communications systems wherein speech quality, data rate, size and cost are significant issues.

In a CELP speech coder, the long-term (pitch) and the short-term (formant) predictors which model the characteristics of the input speech signal are incorporated in a set of time varying filters. Specifically, a long-term and a short-term filter may be used. An excitation signal for the filters is chosen from a codebook of stored innovation sequences, or codevectors.

For each frame of speech, an optimum excitation signal is chosen. The speech coder applies An individual codevector to the filters to generate a reconstructed speech signal. The reconstructed speech signal is compared to the original input speech signal, creating on error signal. The error signal is then weighted by passing it through a spectral noise weighting filter. The spectral noise weighing filter has a response based on human auditory perception. The optimum excitation signal is a selected codevector which produces the weighted error signal with the minimum energy for the current frame of speech.

Typically, linear predictive coding (LPC) is used to model the short term signal correlation over a block of samples, also referred to as the short term filter. The short term signal correlation represents the resonance frequencies of the vocal tract. The LPC coefficients are one set of speech model parameters. Other parameter sets may be used to characterize the excitation signal which is applied to the short term predictor filter.

A speech coder typically quantizes the LAC parameters to reduce the number of bits necessary to characterize the signal. The LPC coefficients may be transformed into other parameter sets prior to quantization. These other speech model parameter sets include: Line Spectral Frequencies (LSF), cepstral coefficients, reflection coefficients, log area ratios, autocorrelation vectors and arc sines. The coefficients my be quantized individually (scalar quantization) or they my be quantized as a set (vector quantization). Scalar quantization is not as efficient as vector quantization, however, scalar quantization is less expensive in computational and memory requirements than vector quantization. Vector quantization of LPC parameters is used for applications where coding efficiency is of prime concern.

Multi-segment or alternately multistage vector quantization may be used to balance coding efficiency, vector quantizer search complexity, and vector quantizer storage requirements. A multi-segment vector quantizes partitions a $N_p$-element LPC parameter vector into n segments. Each of the n segments is vector quantized separately. A multi-stage vector quantizer uses multiple codebooks, where each codebook spans all $N_p$ vector elements. For illustration of vector quantization assume $N_p$=10 elements and that 20 bits are allocated for coding the LPC parameters. Traditional vector quantization would require $2^{20}$ codevectors of 10 elements each to define the codebook. A multi-segment vector quantizer with two segments would require $2^{10}+2^{10}$ codevectors of 5 elements each. A multi-stage vector quantizer with 2 stages would require $2^{10}+2^{10}$ codevectors of 10 elements each. Each of these methods of vector quantization offers differing benefits in coding efficiency, search complexity and storage requirements. The speech coder state of the art would benefit from a vector quantizer method and apparatus which increases the coding efficiency or reduces search complexity or storage requirements.

DESCRIPTION OF A PREFERRED EMBODIMENT

A variation on Code Excited Linear Predictive Coding (CELP) called Vector-Shin Excited Linear Predictive Coding (VSELP), described herein, is a preferred embodiment of the present invention. VSELP uses An excitation codebook having a predefined structure, such that the computations required for the codebook search process are significantly reduced. This VSELP speech coder uses a single or multi-segment vector quantizer of the reflection coefficients based on a Fixed-Point-Lattice-Technique (FLAT). Additionally, this speech coder uses a pre-quantizer to reduce the vector codebook search complexity and a high-resolution scalar quantizer to reduce the amount of memory needed to store the reflection coefficient vector codebooks. The result is a high performance vector quantizer of the reflection coefficients, which is also computationally efficient, and has reduced storage requirements.

Figure 1:
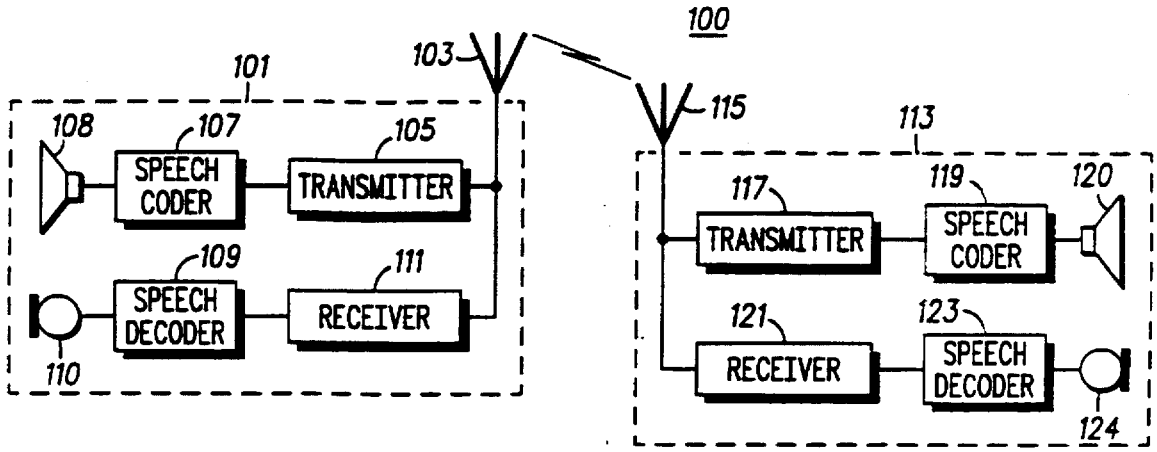
FIG. 1 is a block diagram of a radio communication system including a speech coder in accordance with the present invention.

FIG. 1 is a block diagram of a radio communication system 100. The radio communication system 100 includes two transceivers 101, 113 which transmit and receive speech data to and from each other. The two transceivers 101, 113 may be part of a trunked radio system or a radiotelephone communication system or any other radio communication system which transmits and receives speech data. At the transmitter, the speech signals are input into microphone 108, and the speech coder selects the quantized parameters of the speech model. The codes for the quantized parameters are then transmitted to the other transceiver 113. At the other transceiver 113, the transmitted codes for the quantized parameters are received 121 and used to regenerate the speech in the speech decoder 123. The regenerated speech is output to the speaker 124.

Figure 2:
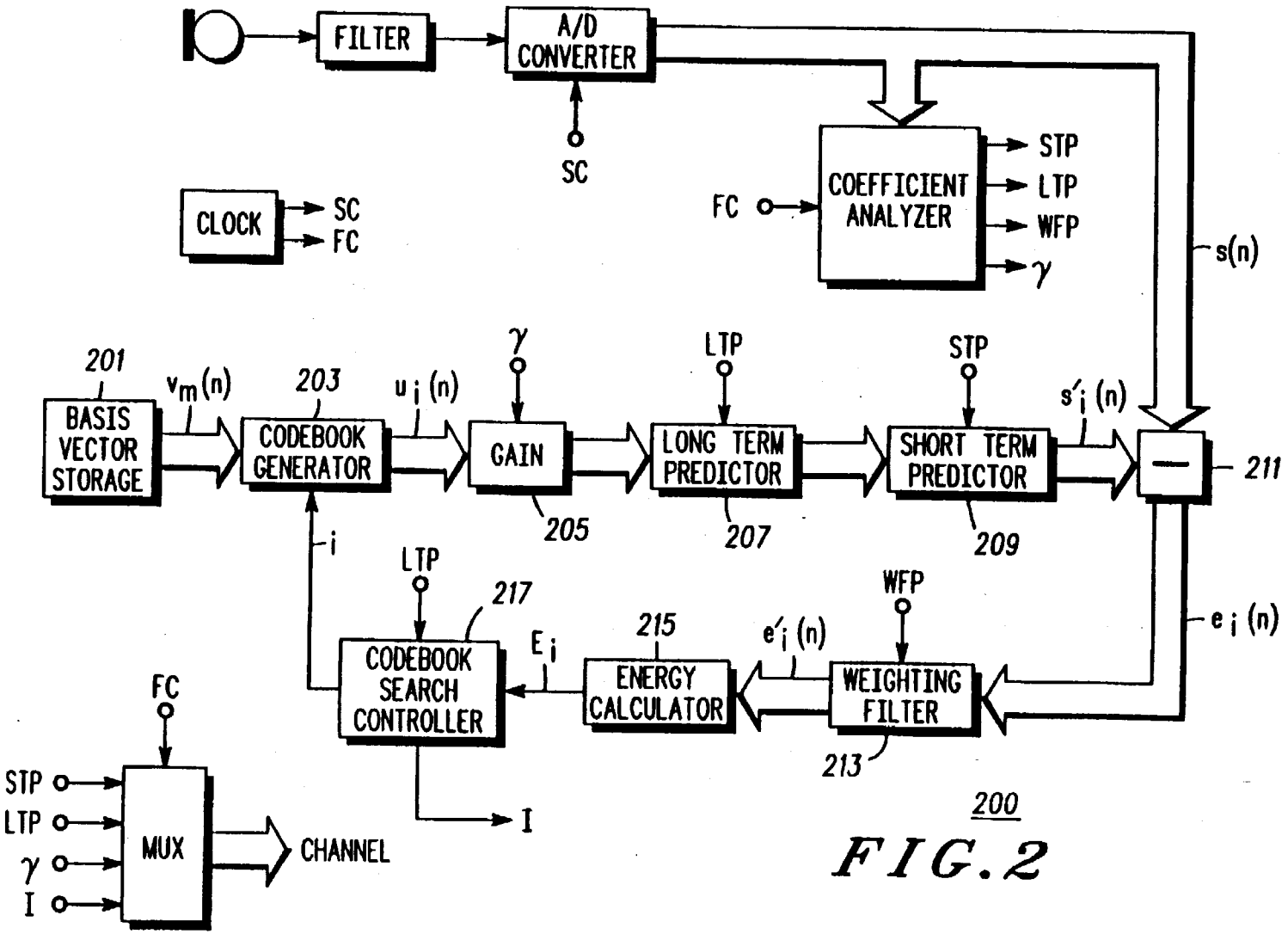
FIG. 2 is a block diagram of a speech coder in accordance with the present invention.

FIG. 2 is a block diagram of a VSELP speech coder 200. A VSELP speech coder 200 uses a received code to determine which excitation vector from the codebook to use. The VSELP coder uses an excitation codebook of $2^M$ codevectors which is constructed from M basis vectors. Defining $v_m(n)$ as the mth basis vector and $u_i(n)$ as the ith codevector in the codebook, then:

$$u_i(n) = \sum_{m=1}^{M} \theta_{im} v_m(n) \tag{1.10}$$

where $0 \leqq i \leqq 2^M-1$; $0 \leqq n \leqq N-1$. In other words, each codevector in the codebook is constructed as a linear combination of the M basis vectors. The linear combinations are deigned by the θ parameters.

$\theta_i m$ is defined as:

$\theta_i m=+1$ $\theta_i m=-1$ if bit m of codeword i=0

Codevector i is constructed as the sum of the M basis vectors where the sign (plus or minus) of each basis vector is determined by the state of the corresponding bit in codeword i. Note that if we complement rill the bits in codeword i, the corresponding codevector is the negative of codevector i. Therefore, for every codevector, its negative is also a codevector in the codebook. These pairs are called complementary codevectors since the corresponding codewords are complements of each other.

After the appropriate vector has been chosen, the gain block 205 scales the chosen vector by the gain term, γ. The output of the gain block 205 is applied to a set of linear filters 207, 209 to obtain N samples of reconstructed speech. The filters include a "long-term" (or "pitch") filter 207 which inserts pitch periodicity into the excitation. The output of the "long-term" filter 207 is then applied to the "short-term" (or "formant") filter 209. The short term filter 209 adds the spectral envelope to the signal.

The long-term filter 207 incorporates a long-term predictor coefficient (LTP). The long-term filter 207 attempts to predict the next output sample from one or more samples in the distant past. If only one past sample is used in the predictor, than the predictor is a single-tap predictor. Typically one to three taps are used. The transfer function for a long-term ("pitch") filter 207 incorporating a single-tap long-term predictor is given by (1.1).

$$B(z) = \frac{1}{1-\beta z^{-L}} \tag{1.1}$$

B(z) is characterized by two quantifies L and β. L is called the "lag". For voiced speech, L would typically be the pitch period or a multiple of it. L may also be a non integer value. If L is a non integer, an interpolating finite impulse response (FIR) filter is used to generate the fractionally delayed samples. β is the long-term (or "pitch") predictor coefficient.

The short-term filter 209 incorporates short-term predictor coefficients, $\alpha_i$, which attempt to predict the next output sample from the preceding Np output samples. Np typically ranges from 8 to 12. In the preferred embodiment, Np is equal to 10. The short-term filter 209 is equivalent to the traditional LPC synthesis filter. The transfer function for the short-term filter 209 is given by (1.2).

$$A(z) = \frac{1}{1-\sum_{i=1}^{N_P} \alpha_i z^{-i}} \tag{1.2}$$

The short-term filter 209 is characterized by the $\alpha_i$ parameters, which are the direct form filter coefficients for the all-pole "synthesis" filter. Details concerning the $\alpha_i$ parameters can be found below.

The various parameters (code, gain, filter parameters) are not all transmitted at the same rate to the synthesizer (speech decoder). Typically the short term parameters are updated less often than the code. We will define the short term parameter update rate as the "frame rate" and the interval between updates as a "frame". The code update rate is determined by the vector length, N. We will define the code update rate as the "subframe rate" and the code update interval as a "subframe". A frame is usually composed of an integral number of subframes. The gain and long-term parameters may be updated at either the subframe rate, the frame rate or some rate in between depending on the speech coder design.

The codebook search procedure consists of trying each codevector as a possible excitation for the CELP synthesizer. The synthesized speech, s'(n), is compared 211 against the input speech, s(n), and a difference signal, $e_i$, is generated. This difference signal, $e_i(n)$, is then filtered by a spectral weighting filter, W(z) 213, (and possibly a second weighting filter, C(z)) to generate a weighted error signal e'(n). The power in e'(n) is computed at the energy calculator 215. The codevector which generates the minimum weighted error power is chosen as the codevector for that subframe. The spectral weighting filter 213 serves to weight the error spectral based on perceptual considerations. This weighting filter 213 is a function of the speech spectrum and can be expressed in terms of the α parameters of the short term (spectral) filter 209.

$$W(z) = \frac{1-\sum_{i=1}^{N_P} \alpha_i z^{-i}}{1-\sum_{i=1}^{N_P} \tilde{\alpha}_i z^{-i}} \tag{1.3}$$

where $\tilde{\alpha}$ is a function of $\alpha$.

There are two approaches that can be used for calculating the gain, γ. The gain can be determined prior to codebook search based on residual energy. This gain would then be fixed for the codebook search. Another approach is to optimize the gain for each codevector during the codebook search. The codevector which yields the minimum weighted error would be chosen and its corresponding optimal gain would be used for γ. The latter approach generally yields better results since the gain is optimized for each codevector. This approach also implies that the gain term must be updated at the subframe rate. The optimal code and gain for this technique can be computed as follows:

1. Compute y(n), the weighted input signal, for the subframe.
2. Compute d(n); the zero-input response of the B(z) and W(z) (and C(z) if used) filters for the subframe. (Zero input response is the response of the filters with no input; the decay of the filter states.)
3. p(n)=y(n)−d(n) over subframe ($0 \leqq n \leqq N-1$)
4. for each code i
   a. Compute $g_i(n)$, the zero state response of B(z) and W(z) (and C(z) if used) to codevector i. (Zero-state response is the filter output with initial filter states set to zero.)
   b. Compute $$C_i = \sum_{n=0}^{N-1} g_i(n)p(n) \tag{1.5}$$

the cross correlation between the filtered codevector i and p(n)

C. Compute $$G_i = \sum_{n=0}^{N-1} (g_i(n))^2 \quad (1.6)$$

the power in the filtered codevector i.

5. Choose i which maximizes $$\frac{(C_i)^2}{G_i} \quad (1.7)$$

6. Update filter states of B(z) and W(z) (and C(z) if used) filters using chosen codeword and its corresponding quantized gain. This is done to obtain the same filter states that the synthesizer would have at the start of the next subframe for step 2.

The optimal gain for codevector i is given by (1.8)

$$\gamma_i = \frac{C_i}{G_i} \quad (1.8)$$

And the total weighted error for codevector i using the optimal gain, $\gamma_i$ is given by (1.9).

$$E_i = \left( \sum_{n=0}^{N-1} p^2(n) \right) - \frac{(C_i)^2}{G_i} . \quad (1.9)$$

The short term predictor parameters are the $\alpha_i$'s of the short term filter 209 of FIG. 2. These are standard LPC direct form filter coefficients and any n-tuber of LPC analysis techniques can be used to determine these coefficients. In the preferred embodiment, a fast fixed point covariance lattice algorithm (FLAT) was implemented. FLAT has all the advantages of lattice algorithms including guaranteed filter stability, non-windowed analysis, and the ability to quantize the reflection coefficients within the recursion. In addition FLAT is numerically robust and can be implemented on a fixed-point processor easily.

The short term predictor parameters are computed from the input speech. No pre-emphasis is used. The analysis length used for computation of the parameters is 170 samples ($N_A$=170). The order of the predictor is 10 ($N_P$=10).

This section will describe the details of the FLAT algorithm. Let the samples of the input speech which fall in the analysis interval be represented by s(n); $0 \leqq n \leqq N_A-1$. Since FLAT is a lattice algorithm one can view the technique as trying to build an optimum (that which minimizes residual energy) inverse lattice filter stage by stage. Defining bj(n) to be the backward residual out of stage j of the inverse lattice filter and fj(n) to be the forward residual out of stage j of the inverse lattice filter we can define:

$$F_j(i,k) = \sum_{n=N_P}^{N_A-1} f_j(n-i) f_j(n-k) \quad (2.1)$$

the autocorrelation of fj(n);

$$B_j(i,k) = \sum_{n=N_P}^{N_A-1} b_j(n-i-1) b_j(n-k-1) \quad (2.2)$$

the autocorrelation of bj(n−1) and:

$$C_j(i,k) = \sum_{n=N_P}^{N_A-1} f_j(n-i) b_j(n-k-1) \quad (2.3)$$

the cross correlation between fj(n) and bj(n−1). Let rj represent the reflection coefficient for stage j of the inverse lattice. Then:

$$F_j(i,k) = F_{j-1}(i,k) + r_j(C_{j-1}(i,k) + C_{j-1}(k,i)) + r_j^2 B_{j-1}(i,k) \quad (2.4)$$

and $$B_j(i,k) = B_{j-1}(i+1,k+1) + r_j(C_{j-1}(i+1,k+1) + C_{j-1}(k+1,i+1)) + r_j^2 F_{j-1}(i+1, k+1) \quad (2.5)$$

and $$C_j(i,k) = C_{j-1}(i,k+1) + r_j(B_{j-1}(i,k+1) + F_{j-1}(i,k+1)) + r_j^2 C_{j-1}(k+1,i) \quad (2.6)$$

The formulation we have chosen for the determination of rj can be expressed as:

$$r_j = -2 \frac{C_{j-1}(0,0) + C_{j-1}(N_P-j, N_P-j)}{F_{j-1}(0,0) + B_{j-1}(0,0) + F_{j-1}(N_P-j, N_P-j) + B_{j-1}(N_P-j, N_P-j)} \quad (2.7)$$

The FLAT algorithm can now be stated as follows.

1. First compute the covariance (autocorrelation) matrix from the input speech:

$$\phi(i,k) = \sum_{N_P}^{N_A-1} s(n-i) s(n-k) \quad (2.8)$$

for $0 \leqq i,k \leqq N_P$.

2. $F_0(i,k) = f(i,k)$ $0 \leqq i,k \leqq N_P-1$ (2.9)

$B_0(i,k) = f(i+1,k+1)$ $0 \leqq k \leqq N_P-1$ (2.10)

$C_0(i,k) = f(i,k+1)$ $0 \leqq i,k \leqq N_P-1$ (2.11)

3. set j=1
4. Computer rj using (2.7)
5. If j=$N_P$ then done.
6. Compute Fj(i,k) $0 \leqq i,k \leqq N_{P-j}-1$ using (2.4)
   Compute Bj(i,k) $0 \leqq k \leqq N_P-j-1$ using (2.5)
   Compute Cj(i,k) $0 \leqq i,k \leqq N_P-j-1$ using (2.6)
7. j=j+1; go to 4.

Prior to solving for the reflection coefficients, the $\phi$ array is modified by windowing the autocorrelation functions.

$$\phi'(i,k) = \phi(i,k) w(|i-k|) \quad (2.12)$$

Windowing of the autocorrelation function prior to reflection coefficient computation is known as spectral smoothing (SST).

From the reflection coefficients, $r_j$, the short term LPC predictor coefficients, $\alpha_i$, may be computed.

A 28-bit three segment vector quantizer of the reflection coefficients is employed. The segments of the vector quantizer span reflection coefficients r1–r3, r4–r6, and r7–r10 respectively. The bit allocations for the vector quantizer segments are:

*Q1* 11 bits
*Q2* 9 bits
*Q3* 8 bits.

To avoid the computational complexity of an exhaustive vector quantizer search, a reflection coefficient vector prequantizer is used at each segment. The prequantizer size at each segment is:

*P1* 6 bits
*P2* 5 bits
*P3* 4 bits

At a given segment, the residual error due to each vector from the prequantizer is computed and stored in temporary memory. This list is searched to identify the four prequantizer vectors which have the lowest distortion. The index of each selected prequantizer vector is used to calculate an offset into the vector quantizer table at which the contiguous subset of quantizer vectors associated with that prequantizer vector begins. The size of each vector quantizer subset at the k-th segment is given by:

$$S_k=\frac{2^{Q_k}}{2^{P_k}} \tag{2.13}$$

The four subsets of quantizer vectors, associated with the selected prequantizer vectors, are searched for the quantizer vector which yields the lowest residual error. Thus at the first segment 64 prequantizer vectors and 128 quantizer vectors are evaluated, 32 prequantizer vectors and 64 quantizer vectors are evaluated at the second segment, and 16 prequantizer vectors and 64 quantizer vectors are evaluated at the third segment. The optimal reflection coefficients, computed via the FLAT technique with bandwidth expansion as previously described are converted to an autocorrelation vector prior to vector quantization.

Figure 4:
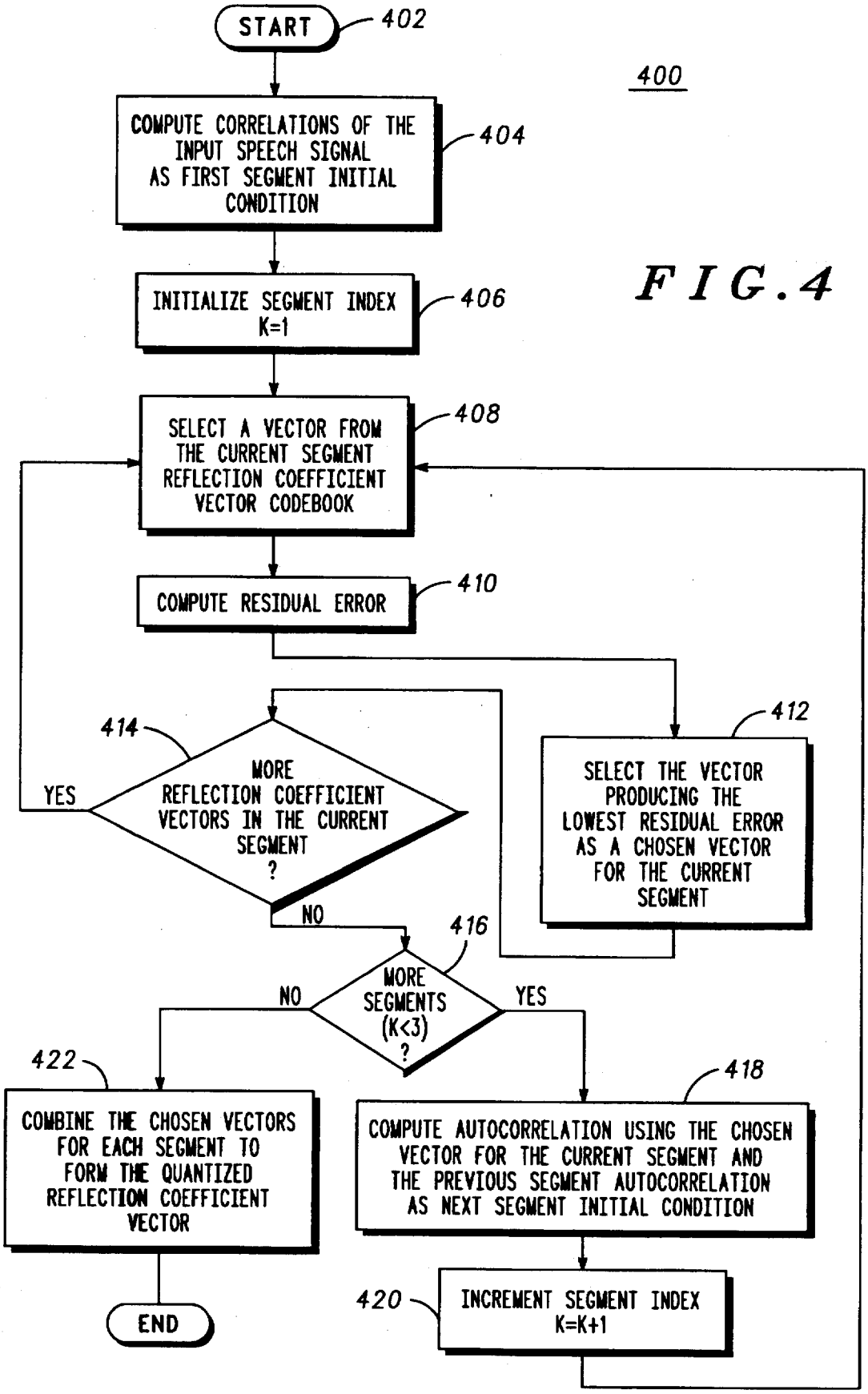
FIG. 4 is a flow diagram illustrating a method in accordance with the present invention.

An autocorrelation version of the FLAT algorithm, AFLAT, is used to compute the residual error energy for a reflection coefficient vector being evaluated. Like FLAT, this algorithm has the ability to partially compensate for the reflection coefficient quantization error from the previous lattice stages, when computing optimal reflection coefficients or selecting a reflection coefficient vector from a vector quantizer at the current segment. This improvement can be significant for frames that have high reflection coefficient quantization distortion. Referring now to FIG. 4, a method 400 of vector quantizing a reflection coefficient vector using the AFLAT algorithm, in the context of multi-segment vector quantization with prequantizers, is now described:

Compute the autocorrelation sequence R(i), from the optimal reflection coefficients, over the range $0 \leqq i \leqq N_p$ (Step 404). Alternatively, the autocorrelation sequence may be computed from other LPC parameter representations, such as the direct form LPC predictor coefficients, $\alpha_i$, or directly from the input speech.

Define the initial conditions for the AFLAT recursion:

$$\bar{P}_o(i)=R(i),\ 0 \leqq i \leqq N_p-1 \tag{2.14}$$

$$\bar{V}_o(i)=R(|i+1|),\ 1-N_p \leqq i \leqq N_p-1 \tag{2.15}$$

Initialize k, the vector quantizer segment index (step 404):

$$k=1 \tag{2.16}$$

Let $I_l(k)$ be the index of the first lattice stage in the k-th segment, and $I_h(k)$ be the index of the last lattice stage in the k-th segment. The recursion for evaluating the residual error out of lattice stage $I_h(k)$ at the k-th segment, given $\hat{r}$, a reflection coefficient vector from the prequantizer or the reflection coefficient vector from the quantizer is given below.

Initialize j, the index of the lattice stage, to point to the beginning of the k-th segment (step 408):

$$j=I_l(k) \tag{2.17}$$

Set the initial conditions Pj−1 and Vj−1 to:

$$P_{j-1}(i)=\bar{P}_{j-1}(i),\ 0 \leqq i \leqq I_h(k)-I_l(k)+1 \tag{2.18}$$

$$V_{j-1}(i)=\bar{V}_{j-1}(i),\ -I_h(k)+I_l(k)-1 \leqq i \leqq I_h(k)-I_l(k)+1 \quad +\text{tm} \tag{2.19}$$

Compute the values of $V_j$ and $P_j$ arrays using:

$$P_j(i)=(1+\hat{r}_j^2)P_{j-1}(i)+\hat{r}_j[V_{j-1}(i)+V_{j-1}(-i)],\ 0 \leqq i \leqq I_h(k)-j \tag{2.20}$$

$$V_j(i)=V_{j-1}(i+1)+\hat{r}^2_j V_{j-1}(-i-1)+2\hat{r}_j P_{j-1}(|i+1|),\ j-I_h(k) \leqq i \leqq I_h(k)-1 \tag{2.21}$$

Increment j:

$$j=j+1 \tag{2.22}$$

If $j \leqq I_h(k)$ go to (2.20)

The residual error out of lattice stage $I_h(k)$, given the reflection coefficient vector r (step 410), is given by:

$$E_r=P_{Ih(k)}(0) \tag{2.23}$$

Using the AFLAT recursion outlined, the residual error due to each vector from the prequantizer at the k-th segment is evaluated, the four subsets of quantizer vectors to search are identified, and residual error due to each quantizer vector from the selected four subsets is computed (steps 408, 410, 412 and 414). The index of $\tilde{r}$, the quantizer vector which minimized $E_r$ over all the quantizer vectors in the four subsets, is encoded with $Q_k$ bits.

If k<3 (step 418) then the initial conditions for doing the recursion at segment k+1 need to be computed. Set j, the lattice stage index, equal to:

$$j=I_l(k) \tag{2.24}$$

Compute:

$$\bar{P}_j(i)=(1+\hat{r}_j^2)\bar{P}_{j-1}(i)+\hat{r}_j[\bar{V}_{j-1}(i)+\bar{V}_{j-1}(-i)],\ 0 \leqq i \leqq N_p-j-1 \tag{2.25}$$

$$\bar{V}_j(i)=\bar{V}_{j-1}(i+1)+\hat{r}\times_j^2\bar{V}_{j-1}(-i-1)+2\hat{r}_j\bar{P}_{j-1}(|i+1|),\ j-N_p+1 \leqq i \leqq N_p-j-2 \tag{2.26}$$

Increment j, $$j=j+1 \tag{2.27}$$

If $j \leqq I_h(k)$ go to (2.25).

Increment k, the vector quantizer segment index (step 420):

$$k=k+1 \tag{2.28}$$

If $k \leqq 3$ go to (2.17). Otherwise, the indices of the reflection coefficient vectors for the three segments have been chosen, and the search of the reflection coefficient vector quantizer is terminated (step 422).

Figure 3:
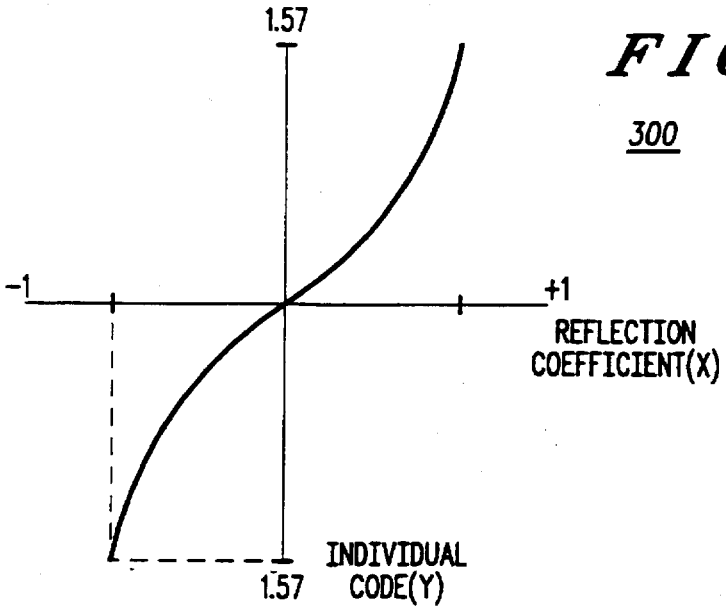
FIG. 3 is a graph of the arcsine function used in accordance with the present invention.

To minimize the storage requirements for the reflection coefficient vector quantizer, eight bit codes for the individual reflection coefficients are stored in the vector quantizer table, instead of the actual reflection coefficient values. The codes are used to look up the values of the reflection coefficients from a scalar quantization table with 256 entries. The eight bit codes represent reflection coefficient values obtained by sampling an arcsine function illustrated in FIG. 3. Reflection coefficient values vary from −1 to +1. The non-linear spacing in the reflection coefficient domain (X axis) provides more precision for reflection coefficients when the values are near the extremes of ±1 and less precision when the values are near 0. This reduces the spectral distortion due to scalar quantization of the reflection coefficients, given 256 quantization levels, as compared to uniform sampling in the reflection coefficient domain.

What is claimed is:

1. A method of vector quantizing a reflection coefficient vector, the reflection coefficient vector having M elements, the reflection coefficient vector representing an input speech signal, the method comprising the steps of:

a) providing a first array of predetermined vectors of reflection coefficients, each predetermined vector having a plurality of L elements, where L<M;

b) correlating the input speech signal in order to form first segment correlations;

c) selecting a first selected vector from the first array of predetermined vectors;

d) calculating a first segment residual error corresponding to the first selected vector and the first segment correlations;

e) repeating steps c) and d) for each predetermined vector of the first array of predetermined vectors;

f) choosing a vector from the first array having lowest first segment residual error, forming a first chosen vector;

g) defining, responsive to the first chosen vector and the first segment correlations, a set of second segment correlations;

h) providing a second array of predetermined vectors of reflection coefficients, each predetermined vector having K elements, where L+K≦M;

i) selecting a second selected vector from the second array of predetermined vectors;

j) calculating a second segment residual error corresponding to the second selected vector and the set of second segment correlations;

k) repeating steps i) and j) for each predetermined vector of the second array;

l) choosing a vector from the second array having lowest second segment residual error, forming a second chosen vector; and m) combining at least the first chosen vector and the second chosen vector to form a quantized reflection coefficient vector.

2. A method of vector quantizing a reflection coefficient vector as recited in claim 1 wherein the method further comprises the steps of:

n) defining, responsive to the second chosen vector and the second segment correlations, a set of third segment correlations;

o) providing a third array of predetermined vectors of reflection coefficients, each predetermined vector having P elements, where L+K+P≦M;

p) selecting a third selected vector from the third array of predetermined vectors;

q) calculating a third segment residual error corresponding to the third selected vector and the set of third segment correlations;

r) repeating steps p) and q) for each predetermined vector in the third array; and s) choosing a vector from the third array having lowest third segment residual error, forming a third chosen vector wherein the step of combining includes the step of combining the third chosen vector with the first chosen vector and the second chosen vector to form the quantized reflection coefficient vector.

3. A method of vector quantizing a reflection coefficient vector as recited in claim 2 wherein M is 10 and wherein each vector of the first array has three elements, each vector of the second array has three elements and each vector of the third array has four elements.

4. A method of vector quantizing a reflection coefficient vector as recited in claim 3 wherein each reflection coefficient vector includes ten reflection coefficients designated reflection coefficients one through ten, and wherein each predetermined vector of the first array of predetermined vectors spans reflection coefficient 1, reflection coefficient 2 and reflection coefficient 3, each predetermined vector of the second array of predetermined vectors spans reflection coefficient 4, reflection coefficient 5 and reflection coefficient 6, and each predetermined vector of the third array of predetermined vectors spans reflection coefficient 7, reflection coefficient 8, reflection coefficient 9 and reflection coefficient 10.

5. A method of vector quantizing a reflection coefficient vector as recited in claim 2 wherein the step of initializing the first segment correlations comprises the step of computing an autocorrelation sequence corresponding to the input speech signal.

6. A method of vector quantizing a reflection coefficient vector as recited in claim 5 wherein the step of defining the set of second segment correlations comprises the step of computing an autocorrelation sequence in response to the first chosen vector and the first segment correlations, and wherein the step of defining the set of third segment correlations comprises the step of computing an autocorrelation sequence in response to the second chosen vector and the set of second segment correlations.

7. A method of vector quantizing a reflection coefficient vector as recited in claim 2 wherein the step of providing the first array of predetermined vectors comprises the step of establishing a first segment reflection coefficient vector codebook, and wherein the step of providing the second array of predetermined vectors comprises the step of establishing a second segment reflection coefficient vector codebook, and wherein the step of providing the third array of predetermined vectors comprises the step of establishing a third segment reflection coefficient vector codebook.

8. A method of vector quantizing a reflection coefficient vector as recited in claim 1 wherein the step of defining the set of second segment correlations comprises use of an autocorrelation lattice recursion technique in response to the first segment correlations and the first chosen vector.

9. A method of vector quantizing a reflection coefficient vector as recited in claim 8 wherein the autocorrelation lattice recursion technique comprises a fixed-point lattice recursion technique.

10. A method of vector quantizing a reflection coefficient vector as recited in claim 1 wherein the step of calculating the first segment residual error comprises using an autocorrelation lattice technique recursion.

11. A method of vector quantizing a reflection coefficient vector as recited in claim 10 wherein the autocorrelation lattice technique recursion comprises a fixed-point lattice technique recursion.

12. A method of vector quantizing a reflection coefficient vector, the reflection coefficient vector having M elements, the reflection coefficient vector representing an input speech signal, the method comprising the steps of:

a) providing a first array of X predetermined vectors of reflection coefficients, each vector having a plurality of L elements, where L≦M;

b) correlating the input speech signal in order to form first segment correlations;

c) pre-quantizing a first segment of the reflection coefficient vector, including the steps of:

c1) providing a second array of Y predetermined vectors of reflection coefficients, each vector having L elements, where X>Y and where each of the Y predetermined vectors is related to at least one of the X predetermined vectors having characteristics similar to the each of the Y predetermined vectors;

c2) calculating a residual error corresponding to each of the Y predetermined vectors and the first segment correlations;

c3) choosing A least-error vectors from the second array having lowest residual error, where A<Y;

c4) selecting a subset of the X predetermined vectors, the subset of the X predetermined vectors being related to the A least-error vectors from the second array by having similar characteristics to the A least-error vectors from the second array;

d) calculating a first segment residual error corresponding to each vector of the subset of the X predetermined vectors and the correlations corresponding to the input speech signal; and e) choosing a first chosen vector from the subset of the X predetermined vectors having lowest first segment residual error to form a quantized reflection coefficient vector.

13. A method of vector quantizing a reflection coefficient vector as recited in claim 12 wherein the method further comprises the steps of:

f) providing a third array of W predetermined vectors of reflection coefficients, each vector having K elements, where L+K≦M;

g) defining, responsive to the first chosen vector and the first segment correlations, a set of second segment correlations;

h) prequantizing a second segment of the reflection coefficient vector, including the steps of:

h1) providing a fourth array of V predetermined vectors of reflection coefficients, each vector having K elements, where L+K≦M and where each of the V predetermined vectors is related to at least one of the W predetermined vectors having characteristics similar to the each of the V predetermined vectors;

h2) calculating a residual error corresponding to each of the V predetermined vectors and the second segment correlations;

h3) choosing B least-error vectors from the fourth array having lowest residual error, where B<V;

h4) selecting a subset of the W predetermined vectors, the subset of the W predetermined vectors being related to the B least-error vectors from the fourth array by having similar characteristics to the B least-error vectors from the fourth array;

i) calculating a second segment residual error corresponding to each vector of the subset of the W predetermined vectors and the second segment correlations;

j) choosing a second chosen vector from the subset of the W predetermined vectors having second segment lowest residual error; and k) combining at least the first chosen vector and the second chosen vector to form the quantized reflection coefficient vector.

14. A method of vector quantizing a reflection coefficient vector as recited in claim 13 wherein the method further comprises the steps of:

l) providing a fifth array of U predetermined vectors of reflection coefficients, each vector having P elements, where L+K+F≦M;

m) defining, responsive to the second chosen vector and the second segment correlations, a set of third segment correlations;

n) prequantizing a third segment of the reflection coefficient vector, including the steps of:

n1) providing a sixth array of S predetermined vectors of reflection coefficients, each vector having P elements, where L+K+P≦M and where each of the S predetermined vectors is related to at least one of the U predetermined vectors having characteristics similar to the each of the S predetermined vectors;

n2) calculating a residual error corresponding to each of the S predetermined vectors and the third segment correlations;

n3) choosing C least-error vectors from the sixth array having lowest residual error, where C<S;

n4) selecting a subset of the U predetermined vectors, the subset of the U predetermined vectors being related to the C least-error vectors from the sixth array by having similar characteristics to the C least-error vectors from the sixth array;

o) calculating a third segment residual error corresponding to each vector of the subset of the U predetermined vectors and the third segment correlations;

p) choosing a third chosen vector from the subset of the U predetermined vectors having third segment lowest residual error to represent a third segment portion of the quantized reflection coefficient vector; and q) combining the first chosen vector, the second chosen vector and the third chosen vector to form the quantized reflection coefficient vector.

* * * * *

UNITED STATES PATENT AND TRADEMARK OFFICE

CERTIFICATE OF CORRECTION

PATENT NO. : 5,675,702

DATED : October 7, 1997

INVENTOR(S) : Gerson et al.

It is certified that error appears in the above-indentified patent and that said Letters Patent is hereby corrected as shown below:

At column 7, line 48, please replace "404" with -- 406 --.

Signed and Sealed this

Sixth Day of January, 1998

*Attest:*

*Attesting Officer*

BRUCE LEHMAN

*Commissioner of Patents and Trademarks*